US007222432B2

(12) United States Patent
Pai et al.

(10) Patent No.: US 7,222,432 B2
(45) Date of Patent: May 29, 2007

(54) METHOD OF ASSEMBLING RETICLE MODULE

(75) Inventors: Shih-Yu Pai, Taichung (TW); Chia-Chun Chang, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 371 days.

(21) Appl. No.: 10/904,822

(22) Filed: Dec. 1, 2004

(65) Prior Publication Data

US 2006/0033915 A1 Feb. 16, 2006

(30) Foreign Application Priority Data

Aug. 16, 2004 (TW) ..... 93124511 A

(51) Int. Cl.
*F41G 1/38* (2006.01)
*F41G 1/00* (2006.01)

(52) U.S. Cl. ..... 33/297; 29/407.01; 29/525.01; 42/130

(58) Field of Classification Search ..... 33/297, 33/298, 286, 613, 645; 42/122, 130, 141; 29/464, 466, 468, 407.01, 407.04, 407.09, 29/407.1, 525.01, 525.11, 525.13
See application file for complete search history.

(56) References Cited

U.S. PATENT DOCUMENTS 2,378,545 A * 6/1945 Fraser et al. ..... 73/167
2,797,485 A * 7/1957 Lewis ..... 33/286
2,806,287 A * 9/1957 Sullivan ..... 33/297
2,807,981 A * 10/1957 Barnes ..... 359/427
3,744,133 A * 7/1973 Fukushima et al. ..... 33/297
3,801,205 A * 4/1974 Eggenschwyler ..... 356/138
4,141,163 A * 2/1979 Rubin ..... 42/130
4,380,876 A * 4/1983 Strassburg ..... 33/297
4,497,548 A * 2/1985 Burris ..... 359/422
4,618,221 A * 10/1986 Thomas ..... 359/428
4,880,306 A * 11/1989 Murphy ..... 356/153
6,865,022 B2 * 3/2005 Skinner et al. ..... 359/428
7,142,357 B2 * 11/2006 Greenslade ..... 359/353
7,162,810 B2 * 1/2007 Biggs et al. ..... 33/645
2006/0038971 A1 * 2/2006 Liang et al. ..... 355/75

* cited by examiner

*Primary Examiner*—Yaritza Guadalupe-McCall
*Assistant Examiner*—Amy R. Cohen
(74) *Attorney, Agent, or Firm*—Jiang Chyun IP Office

(57) ABSTRACT

A method of assembling a reticle module comprising a first element and a second element is provided. The method includes the following steps. First, a collimated beam of light shines on a first reticle of the first member and a second reticle of the second member to project an image of the first reticle and an image of the second reticle onto a screen. Thereafter, the projected image of the first reticle of the first element and the projected image of the second reticle of the second element are adjusted to align with each other. Then, the relative position between first and the second element is fixed. The method speeds up the process of assembling a reticle module and ensures both constituent reticles aligned in the same viewing direction.

13 Claims, 5 Drawing Sheets

METHOD OF ASSEMBLING RETICLE MODULE

CROSS-REFERENCE TO RELATED APPLICATION

This application claims the priority benefit of Taiwan application serial no. 93124511, filed Aug. 16, 2004.

BACKGROUND OF THE INVENTION

1. Field of the Invention

The present invention relates to a method of assembling an alignment module. More particularly, the present invention relates to a method of assembling a reticle module.

2. Description of the Related Art

A conventional finder module uses a single reticle to align with a target. However, the alignment accuracy of a single reticle finder is quite limited to achieve a higher level of alignment. For example, the finder of a rifle is normally disposed on a plane surface perpendicular to the gun barrel. In other words, the axis of the reticle module is in parallel to the gun barrel. Since the finder and the target may not lie on mutually parallel planes, there is no guarantee that the shooter can hit the target. Moreover, the amount of errors involved may not be perceptible to the human eye.

To increase the accuracy of aiming, a finder having two reticles has been developed. When the plane surface of the finder rests and the plane surface of the target form an angle, the user can easily spot this through the finder because the reticles inside the finder will not overlap. Hence, any spatial misalignment between the target and the finder can be easily recognized through the human eye.

When a finder with dual reticle elements aligns with a target, the reticles must overlap each other completely. Therefore, in the process of assembling this type of finder, the degree of alignment between the two reticles is very important.

SUMMARY OF THE INVENTION

Accordingly, at least one objective of the present invention is to provide a method of assembling a reticle module having higher alignment accuracy.

To achieve these and other advantages and in accordance with the purpose of the invention, as embodied and broadly described herein, the invention provides a method of assembling a dual reticle module. The dual reticle module mainly comprises a first element and a second element. The first element has a first reticle and the second element has a second reticle. The method of assembling the dual reticle module includes providing a screen and a collimated light beam and setting the screen along the path of the collimated light beam. Thereafter, the first element and the second element are disposed between the screen and the collimated light beam. The first reticle and the second reticle are set in a direction perpendicular to the collimated light beam so that the first reticle of the first element and the second reticle of the second element are projected on the screen. The position of the first element and the second element are adjusted until the projected image of the first reticle and the second reticle coincides with each other on the screen. Finally, the relative position between the first element and the second element is fixed.

According to one embodiment of the present invention, the screen has a calibration chart. In addition, the process of adjusting the position of the first element and the second element further comprises overlapping the projected image of the first reticle and the second reticle with the calibration chart on the screen.

The present invention also provides a method of assembling a dual reticle module. The dual reticle module mainly comprises a first element and a second element. The first element has a first reticle and the second element has a second reticle. The method of assembling the dual reticle module includes providing a screen and a collimated light beam and setting the screen along the path of the collimated light beam such that the collimated light beam impinges the screen perpendicularly. Furthermore, the screen has a calibration chart thereon. Thereafter, the first element is disposed between the screen and the collimated light beam so that the first reticle is perpendicular to the collimated light beam. The position of the first element is adjusted until the first reticle overlaps with the calibration chart on the screen. After that, the second element is disposed between the screen and the collimated light beam so that the second reticle is perpendicular to the collimated light beam. Similarly, the position of the second element is adjusted until the second reticle overlaps with the calibration chart on the screen. Finally, the relative position between the first element and the second element is fixed.

According to one embodiment of the present invention, the collimated light beam is provided by a projector or a collimator.

According to one embodiment of the present invention, the method of fixing the relative position between the first element and the second element includes fastening the two together. In one embodiment, the first element and the second element are fastened together using screws, adhesive glue, pressure latches or rivets.

The present invention also provides a method of assembling a reticle module. The reticle module comprises a plurality of elements with each element having a reticle. The method of assembling the reticle module includes providing a screen and a collimated light beam and setting the screen along the path of the collimated light beam. Thereafter, the elements are disposed between the screen and the collimated light beam such that projected images of the reticles is formed on the screen. The reticles of the elements are set in a direction perpendicular to the collimated light beam. The positions of these elements are adjusted until the projected images of the reticles overlap on the screen. Finally, the relative positions between various elements are fixed.

According to the embodiment of the present invention, the screen may have a calibrating chart thereon. Furthermore, the step of adjusting the elements may further include adjusting the positions of the elements so that the projected images of the reticles overlap with the calibrating chart on the screen.

The present invention also provides a method of assembling a reticle module. The reticle module comprises a plurality of elements with each element having a reticle. The method of assembling the reticle module includes providing a screen and a collimated light beam and setting the screen along the path of the collimated light beam such that the collimated light beam impinges the screen perpendicularly. Furthermore, the screen has a calibration chart thereon. Thereafter, each element is sequentially disposed between the screen and the collimated light beam. The reticle of each element is set in a direction perpendicular to the collimated light beam. The position of each element is sequentially adjusted so that the reticle of each element overlaps with the calibrating chart on the screen. Finally, the relative positions of between these elements are fixed.

According to the embodiment of the present invention, the collimated light beam is provided by a projector or a collimator.

According to one embodiment of the present invention, the method of fixing the relative positions between the elements includes fastening the elements together. In one embodiment, the elements are fastened together using screws, adhesive glue, pressure latches or rivets.

The present invention utilizes a collimated light beam to project an image of two or more reticles onto a screen and then adjusts the projected images of the reticles so that the reticles overlap in a direction of extension of the collimated light beam. Ultimately, a reticle module with precise alignment is assembled.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1A:
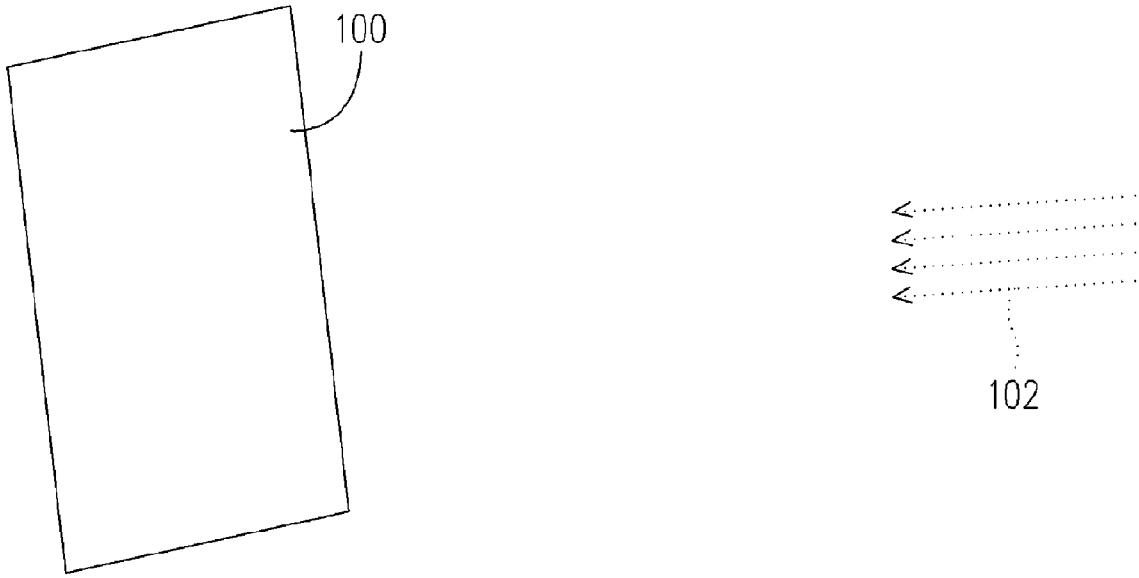
FIGS. 1A through 1C are perspective views showing the method of assembling a dual reticle module according to one preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The process of assembling a reticle module in the present invention utilizes a collimated light beam to ensure a precise overlapping of the reticles. In the following, embodiments are used to explain the method. It should be noted that a dual reticle module is used to illustrate the concept of the present invention. However, the method of the present invention is not limited to the fabrication of a dual reticle module but can be applied to other module having three or more reticles therein.

Figure 1B:
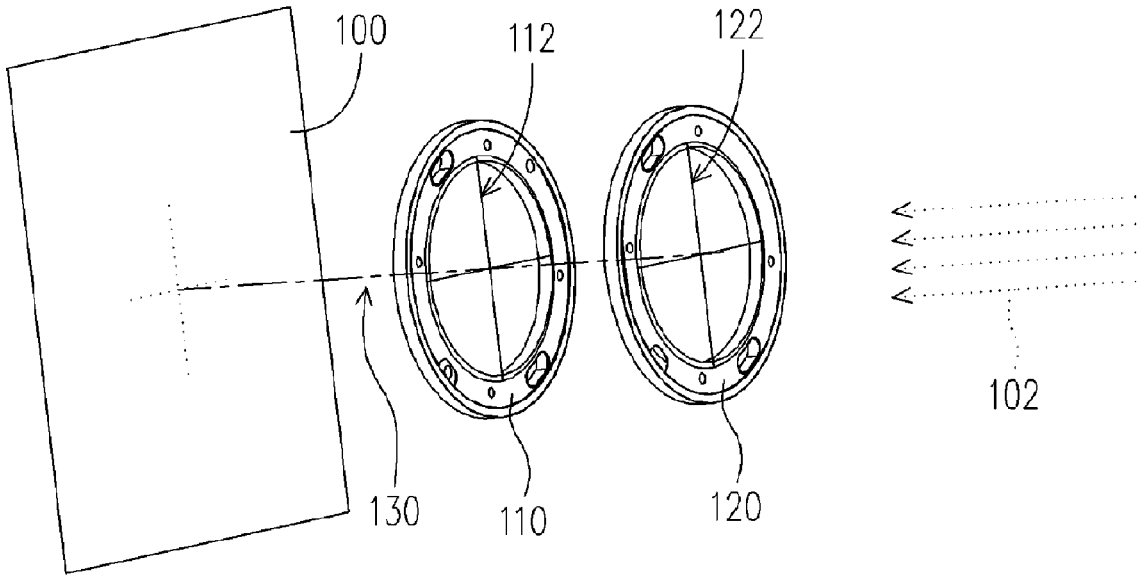
Figure 1C:
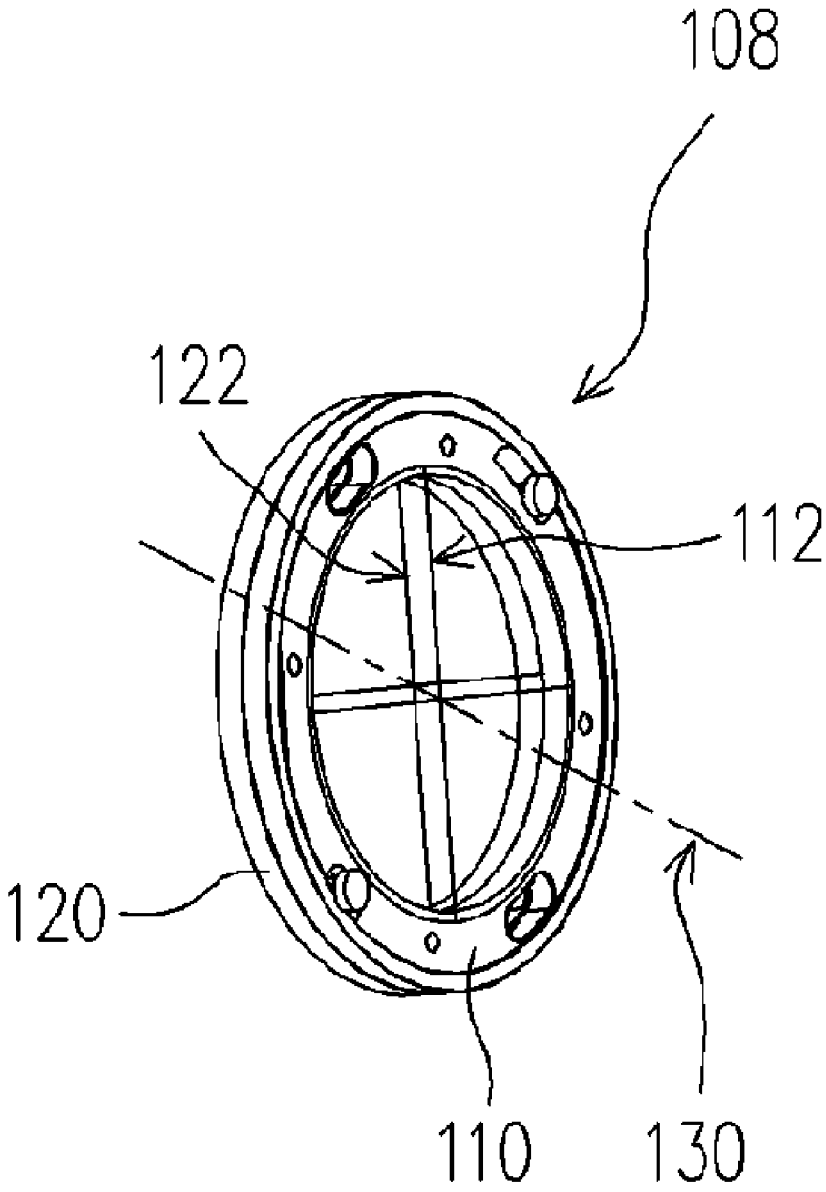

FIGS. 1A through 1C are perspective views showing the method of assembling a dual reticle module according to one preferred embodiment of the present invention. As shown in FIG. 1A, a screen 100 and a collimated light beam 102 are provided. The screen 100 is positioned along the path of the collimated light beam 102 such that the collimated light beam 102 impinges the screen 100 perpendicularly. In the embodiment of the present invention, a projector or a collimator provides the collimated light beam 102.

As shown in FIG. 1B, a first element 110 with a first reticle 112 and a second element 120 with a second reticle 122 are positioned between the collimated light beam 102 and the screen 100. The first reticle 112 and the second reticle 122 are set in a direction perpendicular to the collimated light beam 102. In other words, the direction of travel of the collimated light beam 102 is parallel to the axes 130 of the first element 110 and the second element 120 so that a projected image of the first reticle 112 and the second reticle 122 are formed on the screen 100. The first reticle 112 on the first element 110 and the second reticle 122 on the second element 120 are located in the same relative position. In fact, the first element 110 and the second element 120 are frames for holding the first reticle 112 and the second reticle 122. Thereafter, the relative position between the first element 110 and the second element 120 are adjusted so that the projected image of the first reticle 112 on the screen 100 overlaps with the projected image of the second reticle 122 on the screen 100.

Figure 2:
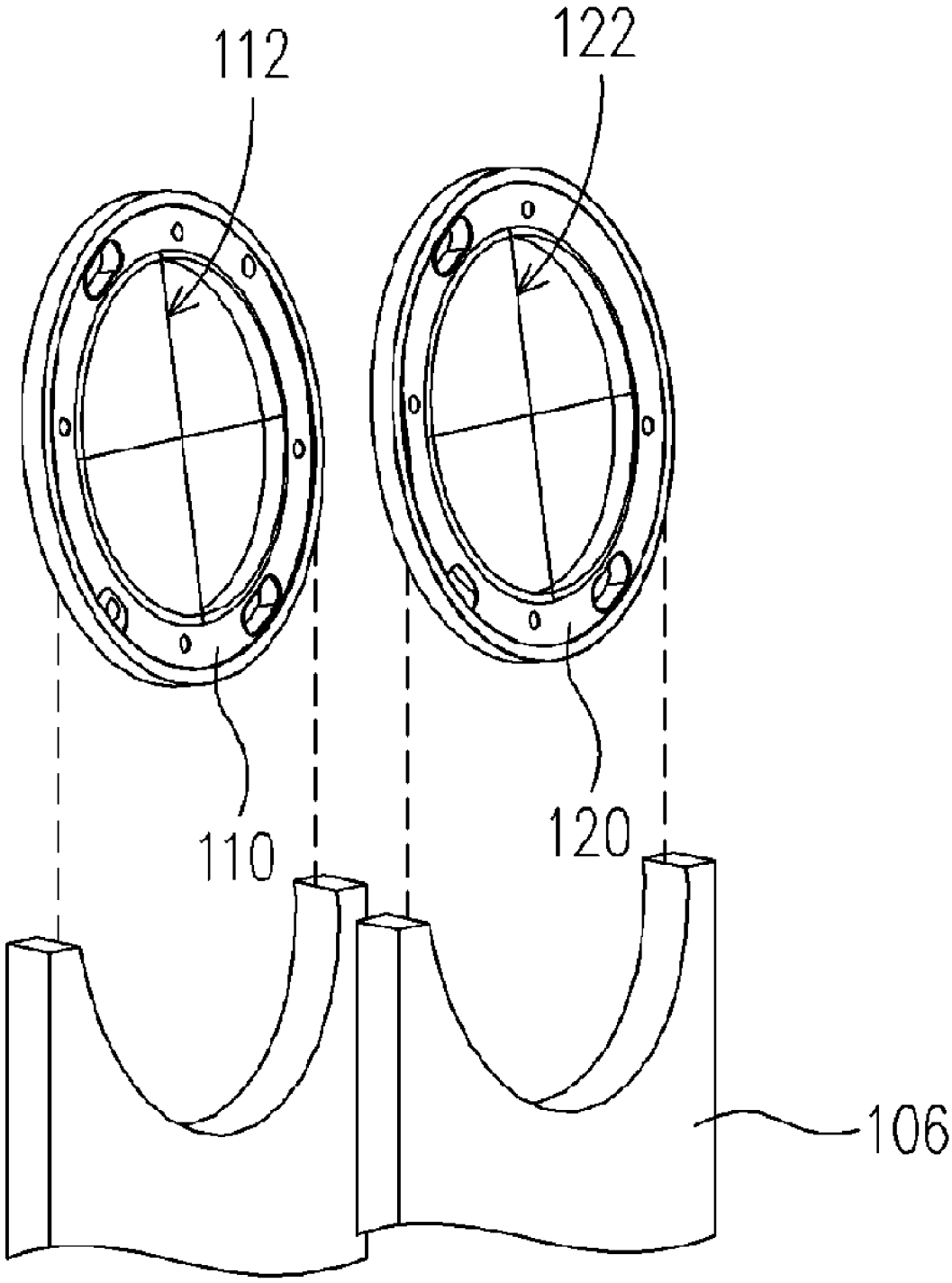
FIG. 2 is a perspective view of a dual reticle module according to another preferred embodiment of the present invention.

As shown in FIG. 1C, the relative position between the first element 110 and the second element 120 is fixed to ensure the first reticle 112 and the second reticle 122 in the axial direction 130 of the first element 110 and the second element 120 coincide. Hence, the process of assembling the dual reticle module 108 is complete. The method of fixing the relative position between the first element 110 and the second element 120 includes fastening the first element 110 and the second element 120 together. For example, the first element 110 and the second element 120 can be fastened together using screws, adhesive glue, pressure latches, rivets or other means. In addition, the first element 110 and the second element 120 may be separately fastened to a carrier 106 (as shown in FIG. 2). The carrier 106 is, for example, a fixture capable of fastening the first element 110 and the second element 120 at a fixed separation. Thus, there is no fixed design in the present invention to set the first element and the second element at a fixed relative position. Anyone familiar with mounting elements together may select a method appropriate to a particular situation and still be considered as within the scope of the present invention.

Figure 3A:
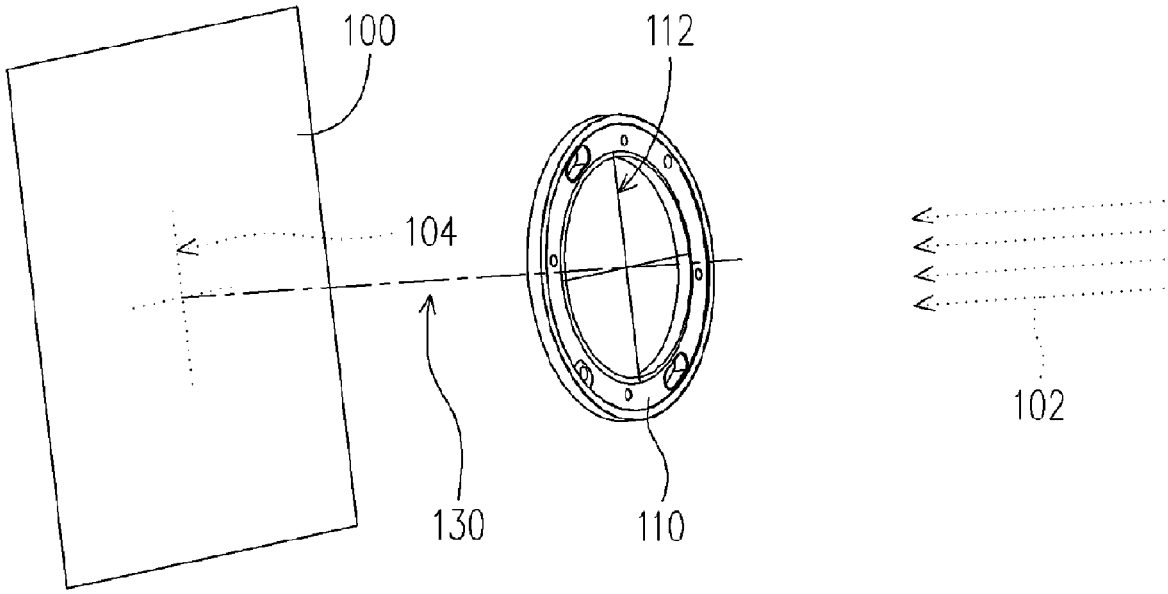
FIGS. 3A and 3B are perspective views showing some of the steps for assembling a dual reticle module according to another preferred embodiment of the present invention.

In another embodiment of the present invention, a calibrating chart 104 is also disposed on the screen 100. In the process of assembling a dual reticle module, the collimated light beam 102 is set to impinge the screen 100 perpendicularly. Thereafter, a first element 110 is disposed between the screen 100 and the collimated light beam 102 so that a projected image of the first reticle 112 appears on the screen 100. The position of the first element 110 is adjusted until the projected image of the first reticle 112 on the screen overlaps with the calibrating chart 104 as shown in FIG. 3A.

Figure 3B:
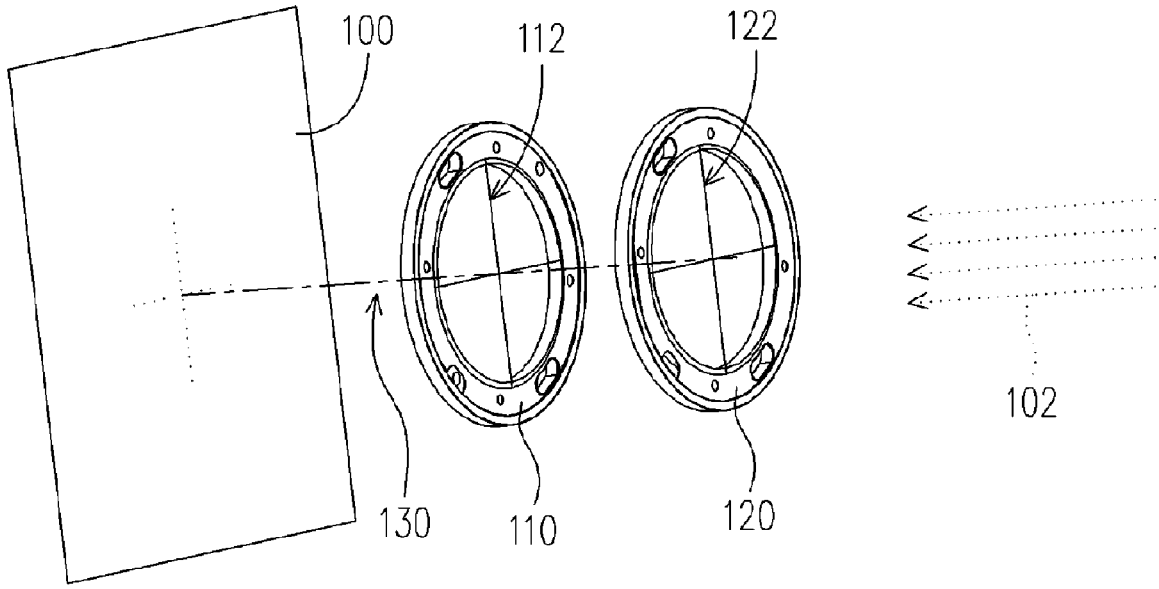

As shown in FIG. 3B, the second element 120 is disposed between the screen 100 and the collimated light beam 102 so that a projected image of the second reticle 122 appears on the screen 100. The second element 120 may be disposed between the screen 100 and the first element 100 or disposed between the first element 110 and the collimated light beam 102. In the present invention, there is no particular constraint on the positioning of the first element 110 and the second element 120 between the screen 100 and the collimated light beam 102. Thereafter, the second element is adjusted so that the projected image of the second reticle 122 overlaps with the calibrating chart 104 on the screen 100. In other words, the projected image of the first reticle 112 and the projected image of the second reticle 122 coincide on the screen 100. Finally, as shown in FIG. 1C, the relative position between the first element 112 and the second element 122 is fixed to complete the process of assembling a dual reticle module.

It should be noted that the present embodiment also permits the simultaneous disposition of the first element 110 and the second element 120 between the screen 100 and the collimated light beam 102. Thereafter, the first element 110 and the second element 120 are simultaneously adjusted so that the projected image of the first reticle 112 and the second reticle 122 overlap with the calibrating chart 104 on the screen 100. In other words, the present invention has no particular constraint on the order of adjustment between the first element 110 and the second element 120.

In summary, the present invention utilizes a collimated light beam to produce a projected image of a first reticle and a second reticle on a screen. By adjusting the projected image of the first reticle and the second reticle, the first reticle and the second reticle in the axial direction of the first element and the second element are made to coincide. It should be noted that a set of lenses could be used to magnify the projected image of the first reticle and the second reticle on the screen. Hence, the projected image of the first reticle and the second reticle on the screen can be used to micro-adjust the relative position between the first reticle and the second reticle and increase their overlapping precision.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of assembling a dual reticle module comprising a first element and a second element, wherein the first element has a first reticle and the second element has a second reticle, the method comprising the steps of:

providing a screen and a collimated light beam, wherein the screen is disposed along the path of the collimated light beam;

disposing the first element and the second element between the screen and the collimated light beam so that a projected image of the first reticle and the second reticle are formed on the screen, wherein the collimated light beam is set in a direction perpendicular to the first reticle and the second reticle;

adjusting the relative position of the first element and the second element so that the projected image of the first reticle overlaps with the projected image of the second reticle on the screen; and fixing the relative position between the first element and the second element as the projected images of first and the second reticles are overlapped together.

2. The method of assembling a dual reticle module of claim 1, wherein a projector or a collimator provides the collimated light beam.

3. The method of assembling a dual reticle module of claim 1, wherein the screen has a calibrating chart thereon and the process of adjusting the relative position of the first element and the second element further comprises adjusting the position of the first element and the second element so that the projected image of the first reticle, the projected image of the second reticle and the calibrating chart on the screen all overlap.

4. The method of assembling a dual reticle module of claim 1, wherein the step of fixing the relative position between the first element and the second element comprises fastening the first element and the second element together.

5. The method of assembling a dual reticle module of claim 4, wherein the first element and the second element are fastened together using screws, adhesive glue, pressure latches or rivets.

6. A method of assembling a dual reticle module comprising a first element and a second element, wherein the first element has a first reticle and the second element has a second reticle, the method comprising the steps of:

providing a screen and a collimated light beam, wherein the screen is disposed along the path of the collimated light beam so that the collimated light beam impinges the screen perpendicularly, and the screen further has a calibrating chart thereon;

disposing the first element between the screen and the collimated light beam so that a projected image of the first reticle is formed on the screen, wherein the collimated light beam is set in a direction perpendicular to the first reticle;

adjusting the position of the first element so that the projected image of the first reticle overlaps with the calibrating chart on the screen;

disposing the second element between the screen and the collimated light beam so that a projected image of the second reticle is formed on the screen, wherein the collimated light beam is set in a direction perpendicular to the second reticle;

adjusting the position of the second element so that the projected image of the second reticle on the screen overlaps with the projected image of the first reticle and the calibrating chart on the screen; and fixing the relative position between the first element and the second element.

7. The method of assembling a dual reticle module of claim 6, wherein a projector or a collimator provides the collimated light beam.

8. The method of assembling a dual reticle module of claim 6, wherein the step of fixing the relative position between the first element and the second element comprises fastening the first element and the second element together.

9. The method of assembling a dual reticle module of claim 8, wherein the first element and the second element are fastened together using screws, adhesive glue, pressure latches or rivets.

10. A method of assembling a reticle module having a plurality of elements and each element having a reticle thereon, the assembling method comprising the steps of:

providing a screen and a collimated light beam, wherein the screen is disposed along the path of the collimated light beam;

disposing the elements between the screen and the collimated light beam so that projected images of the reticles are formed on the screen, wherein the collimated light beam is set in a direction perpendicular to the reticles;

adjusting the relative position of the elements so that the projected images of the reticles overlap each other on the screen; and fixing the relative positions of the elements as the projected images of first and the second reticles are overlapped together.

11. The method of assembling a dual reticle module of claim 10, wherein a projector or a collimator provides the collimated light beam.

12. The method of assembling a dual reticle module of claim 10, wherein the step of fixing the relative positions between the elements comprises fastening the elements together.

13. The method of assembling a dual reticle module of claim 12, wherein the elements are fastened together using screws, adhesive glue, pressure latches or rivets.

* * * * *